US008753140B1

(12) United States Patent
Lytwyn

(10) Patent No.: US 8,753,140 B1
(45) Date of Patent: Jun. 17, 2014

(54) APPARATUS FOR CONNECTING FILAMENTS OF SEPARATE ELECTROLUMINESCENT CABLES TOGETHER

(71) Applicant: Andrew M. Lytwyn, Houston, TX (US)

(72) Inventor: Andrew M. Lytwyn, Houston, TX (US)

( * ) Notice: Subject to any disclaimer, the term of this patent is extended or adjusted under 35 U.S.C. 154(b) by 65 days.

(21) Appl. No.: 13/652,632

(22) Filed: Oct. 16, 2012

Related U.S. Application Data

(60) Provisional application No. 61/550,008, filed on Oct. 21, 2011.

(51) Int. Cl.
*H01R 4/24* (2006.01)

(52) U.S. Cl.
USPC ..... 439/395

(58) Field of Classification Search
USPC ..... 439/387, 587, 402, 417, 404
See application file for complete search history.

(56) References Cited

U.S. PATENT DOCUMENTS

| | | | | |
|---|---|---|---|---|
| 5,820,404 | A * | 10/1998 | Chishima et al. | 439/417 |
| 6,837,737 | B2 * | 1/2005 | Baier et al. | 439/402 |
| 6,932,639 | B2 | 8/2005 | Woodruff | |
| 7,285,012 | B2 * | 10/2007 | Wada et al. | 439/587 |
| 7,737,633 | B2 | 6/2010 | Zheng | |
| 8,246,361 | B2 * | 8/2012 | Dennes et al. | 439/107 |
| 2005/0152126 | A1 * | 7/2005 | Hadar | 362/84 |
| 2005/0213313 | A1 | 9/2005 | Baumberg et al. | |
| 2007/0249204 | A1 * | 10/2007 | Petersen et al. | 439/208 |
| 2008/0265767 | A1 | 10/2008 | Baumberg et al. | |
| 2009/0258533 | A1 * | 10/2009 | Dennes et al. | 439/395 |

* cited by examiner

*Primary Examiner* — Chandrika Prasad
(74) *Attorney, Agent, or Firm* — Egbert Law Offices, PLLC

(57) ABSTRACT

A connector for electroluminescent cables has a first electroluminescent cable having a first wire and a second wire, a second electroluminescent cable having a first wire and a second wire, a body having an interior, a first conductive surface positioned in the interior of the body, and a second conductive surface positioned in the interior of the body. A first wire of the first electroluminescent cable and a first wire of the second electroluminescent cable are electrically connected to the first conductive surface. A second wire of the first electroluminescent cable and a second wire of the second electroluminescent cable are electrically connected to the second conductive surface.

16 Claims, 2 Drawing Sheets

APPARATUS FOR CONNECTING FILAMENTS OF SEPARATE ELECTROLUMINESCENT CABLES TOGETHER

RELATED U.S. APPLICATIONS

The present application claims priority from U.S. Provisional Patent Application Ser. No. 61/550,008, filed on Oct. 21, 2011, and entitled "CONNECTOR FOR ELECTROLUMINESCENT CABLE".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to electroluminescent cable. More particularly, the present invention the relates to connectors that are used to join such electroluminescent cables, and power cords, in a proper end-to-end relationship.

2. Description of Related Art Including Information Disclosed Under 37 CFR 1.97 and 37 CFR 1.98

Electroluminescent cable is a cool-to-the-touch, bendable, vinyl-coated wire that emits a pleasant 360° softly glowing light. Electroluminescent cable has a flexible wire cable having a solid copper center conductor surrounded by a material which is luminescent in an electric field. A pair of thin filaments or wires are shorted together and helically wound around the luminescent material. The assembly is covered with one or two layers of vinyl or other polymeric insulating material.

When an alternating current is conducted through the center conductor and the pair of filaments, the alternating electromagnetic fields between the conductors causes the luminescent material to glow. Although the electroluminescent cable may be powered directly from an AC power supply, the electroluminescent cable is frequently powered by a DC inverter connected to a battery. The color that is emitted by the cable can vary with the frequency of the AC voltage or current. Usually, the voltage must exceed a minimum threshold voltage before the electroluminescent cable will glow.

Electroluminescent cable technology is relatively new and only within the past few years has electroluminescent cable become available in consumer products. Electroluminescent cable is particularly applicable in those applications that require lengths of glowing lights. As such, the electroluminescent cable can replace those applications that involve LEDs or other lamps.

Unfortunately, in the past, it has been very difficult to connect such electroluminescent cables in end-to-end relationships. A complicated technique of stripping the wires and soldering is required in order to properly connect the cables together. Importantly, it is necessary to avoid damage to the filaments to the electroluminescent wire during the soldering procedure. As such, barriers must be incorporated during the soldering operation so as to avoid such damage. A variety of sleeves are required after the connections are achieved so as to provide the proper insulating characteristics. The sleeves or covers are often difficult to apply in such confined locations.

As such, a need has developed so as to provide a connector for electroluminescent cables which allows the electroluminescent cables to be joined in end-to-end relationship.

In the past, various patents have issued relating to such electroluminescent cable. For example, U.S. Patent Publication No. 2005/0152126, published on Jul. 14, 2005 to I. Hadar, shows an electroluminescent cable assembly that includes a reel constructed for winding the cable thereon. A supporting member rotatably mounts the reel for permitting the electroluminescent cable to be deployed therefrom. A self-contained power supply is carried by the reel so as to be rotated therewith and so as to supply electrical power to the electroluminescent cable when deployed from the reel.

U.S. Patent Publication No. 2005/0213313, published on Sep. 29, 2005 to Baumberg et al., shows an electroluminescent lighting filament having a connector at an end thereof that can be removably connected to a connector at an end of another electroluminescent lighting filament so that the electroluminescent lighting filament may be connected to another electroluminescent lighting filament. A storage spool is provided upon which such electroluminescent lighting filament can be stored and unwound.

U.S. Patent Publication No. 2008/0265767, published on Oct. 30, 2008 also to Baumberg et al., provides an electroluminescent cable and method of fabrication thereof. The electroluminescent cable includes a composite core electrode including an elongated flexible metal portion substantially surrounded by one or more layers of a flexible conductive compound. The composite core electrode is surrounded by a dielectric layer, an electroluminescent layer, a transparent conductive layer and a polymer layer.

U.S. Pat. No. 6,932,639, issued on Aug. 23, 2005 to G. Woodruff, describes an electroluminescent cable connector for mechanically and electrically splicing together a pair of electroluminescent cables. Each cable has a center conductor coated with an electroluminescent phosphor and two fine wires spiraling the length of the phosphor coating. The connector has an insulated base into which the electroluminescent wires are inserted at opposite ends. The electroluminescent wires pass through annular sleeves of conducting material which interconnect the thin outer wires of the pair of electroluminescent cables. An electrically conducting jumper is disposed within an insulating cap so as to have a pair of forked protrusions for mechanically engaging and electrically connecting together the center conductors of the electroluminescent cables when the cap nests within the base.

U.S. Pat. No. 7,737,633, issued on Jun. 15, 2010 to Y. Zheng, teaches an electroluminescent wire having a continuous base wire that is plated with a metal modified layer. The metal wire is coated with a dielectric layer. The dielectric layer is coated with a luminous layer made of electroluminescent powder to emit light. The luminous layer is coated with a transparent conductive layer. The surface of the conductive layer connects to one to four protective conductive wires and all are enclosed by a fluoroplastics layer. The fluoroplastics layer is enclosed by a plurality of transparent and translucent colorized plastic tubes.

It is an object of the present invention to provide a connector for electroluminescent cables which allows the electroluminescent cables and/or power cords to be joined in electrically-connected in end-to-end relationship.

It is another object of the present invention to provide a connector for electroluminescent cables which eliminates the need for soldering the filaments and conductors together.

It is still another object of the present invention to provide a connector for electroluminescent cables which avoids the need for the complex sleeving of the separate components during the joining of the cables together.

It is still a further object of the present invention to provide a connector for electroluminescent cables which can be easily applied over the electroluminescent cables in a safe, convenient and efficient manner.

It is still a further object of the present invention to provide a connector for electroluminescent cables which avoids any snagging of the connector on exterior surfaces.

It is still a further object of the present invention to provide a connector for electroluminescent cables which has a very small profile.

It is another object of the present invention to provide a connector for electroluminescent cables which is inexpensive and easy to manufacture.

These and other objects and advantages of the present invention will become apparent from a reading of the attached specification and appended claims.

BRIEF SUMMARY OF THE INVENTION

The present invention is a connector for electroluminescent cables. This connector has a first shell having a separating surface positioned in an interior thereof, a first conductive surface positioned in the interior of the first shell on one side of the separating surface, a second conductive surface positioned in the interior of the first shell on an opposite side of the separating surface, and a second shell cooperative with the first shell so as to extend over the interior of the first shell.

The first shell is hingedly connected to the second shell. The second shell is movable between an open position and a closed position with respect to the interior of the first shell.

The first conductive surface includes a first clip that is positioned in the interior of the first shell, a second clip positioned in the interior of the first shell in spaced relation to the first clip, and a conductor extending between the first clip and the second clip so as to electrically connect to the first and second clips. Each of the first and second clips has a sharp edge suitable for penetrating a coating of a wire of the electroluminescent cable.

The second conductive surface includes a clip positioned in the interior of the first shell, a plate positioned in the interior of the first shell, and a conductor extending in electrical connection between the clip and the plate. The plate extends in generally transverse relationship to the clip. The conductor is a surface that extends adjacent a bottom of the interior of the first shell. The second shell has an abutment surface extending so as to be positioned adjacent to the plate when the first and second shells are in the closed position so as to urge a filament of the electroluminescent cable against the plate. The second shell also has a pair of panels arranged in spaced parallel relationship. The first clip is positioned between the pair of panels when the second shell is in the closed position.

A first elastomeric receptacle is positioned at one end of the first shell. The first elastomeric receptacle has an opening therein suitable for allowing one of the electroluminescent cables to pass therethrough. A second elastomeric receptacle is positioned at an opposite end of the first shell. The second elastomeric receptacle has an opening therein suitable for allowing the other of the electroluminescent cables to pass therethrough.

The separating surface extends vertically within the first shell. The separating surface has one end positioned beyond an end of the first and second conductive surfaces and an opposite end positioned beyond an end of the first and second conductive surfaces. Each of the shells and the separating surface are of a non-conductive material.

The present invention is also a connector apparatus that comprises a first electroluminescent cable having a first wire and a second wire therein, a second electroluminescent cable having a first wire and a second wire therein, a body, a first conductive surface positioned in the interior of the body, and a second conductive surface positioned in the interior of the body. The first electroluminescent cable extends through one end of the body into the interior of the body. The second electroluminescent cable extends through an opposite end of the body into the interior of the body. The first wire of the first electroluminescent cable and the first wire of the second electroluminescent cable are electrically connected to the first conductive surface. The second wire of the first electroluminescent cable and the second wire of the second electroluminescent cable are electrically connected to the second conductive surface.

The body has a first shell and a second shell hingedly connected to the first shell. These shells are movable between an open position and a closed position.

The first conductive surface includes a first clip positioned in the interior of the body, a second clip positioned in the interior of the body in spaced relation to the first clip, and a conductor electrically connecting the first slip to the second clip. The first wire of the first electroluminescent cable is electrically connected to the first clip. The second wire of the second electroluminescent cable is electrically connected to the second clip. Each of the first and second clips has a sharp edge penetrating a coating of the wire so as to electrically connect the wires to the respective clip.

The second conductive surface includes a clip positioned in the interior of the body, a plate positioned in the interior of the body in spaced relationship to the clip, and a conductor electrically connecting the clip to the plate. The second wire of the first electroluminescent cable also electrically connected to the clip. The second wire of the second electroluminescent cable is electrically connected to the plate. The second wire of the second electroluminescent cable includes a pair of filaments each having a surface juxtaposed against the plate.

A separating surface is positioned in the body. The first wire of the first electroluminescent cable and the first wire of the second electroluminescent cable extend along one side of the separating surface. The second wire of the first electroluminescent cable and the second wire of the second electroluminescent cable extend along an opposite side of the separating surface.

A first elastomeric receptacle is positioned at the one end of the body. This first elastomeric receptacle has an opening therein. The first electroluminescent cable extends through the opening of the first elastomeric receptacle. A second elastomeric receptacle is positioned at the opposite end of the body. The second elastomeric receptacle has an opening therein. The second electroluminescent cable extends through the opening of the second elastomeric receptacle.

As used herein, the term "electroluminescent cable" can refer to either the electroluminescent cable which is to be illuminated and/or the power line to an electroluminescent cable. As such, the connector apparatus can be utilizes so as to join a pair of illuminatable electroluminescent cables together in end-to-end relationship or it can be used to join an illuminatable electroluminescent cable to a suitable power line for the electroluminescent cable.

This section is intended to describe, with particularity, the preferred embodiment of the present invention. It is understood that modifications to this preferred embodiment can be made within with the scope of the present invention without departing from the true spirit of the invention. As such, this section should not to be construed, in any way, as limiting of the broad scope of the present invention. The present invention should only be limited by the following claims and their legal equivalents.

DETAILED DESCRIPTION OF THE INVENTION

Figure 1:
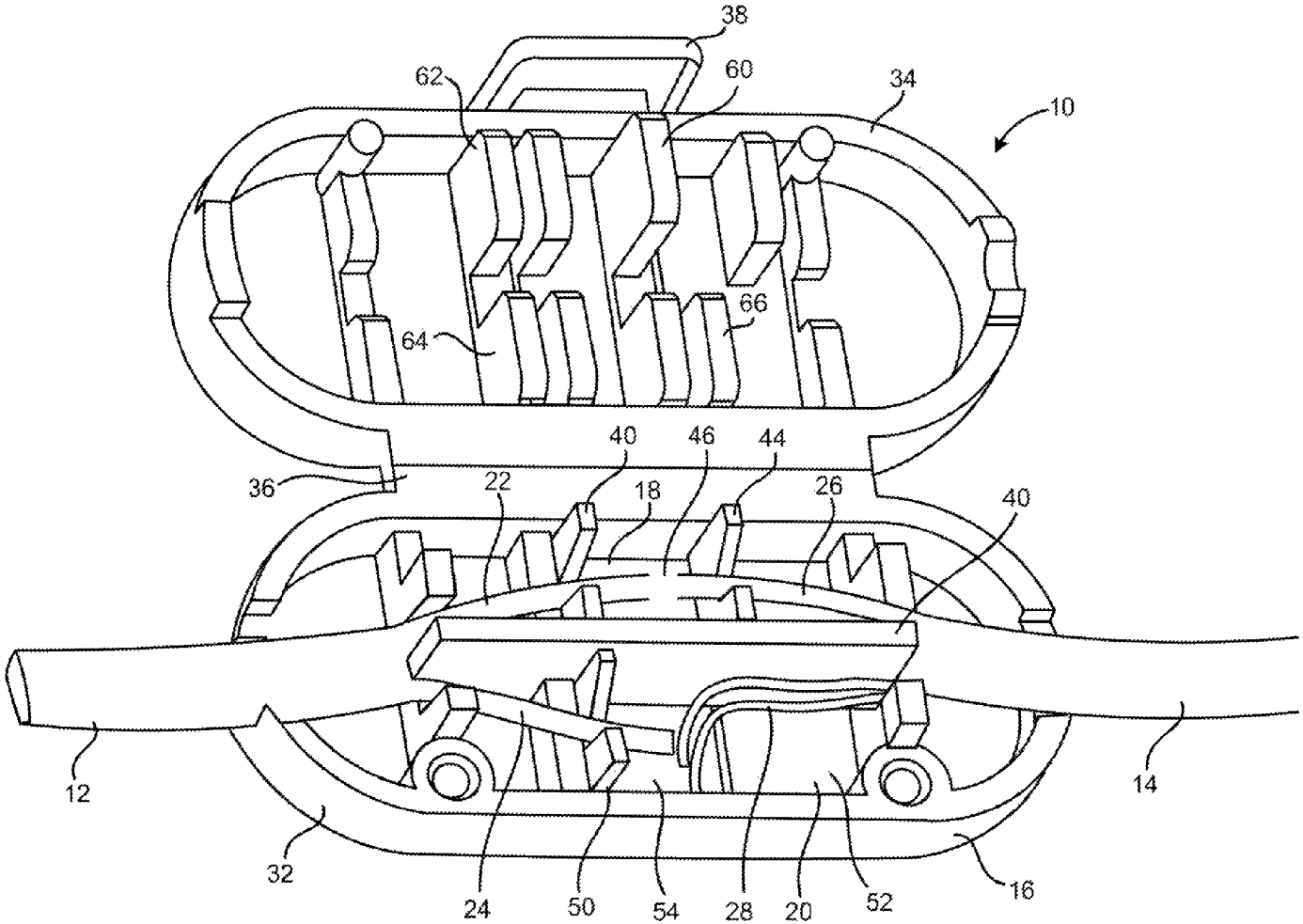
FIG. 1 is a perspective view of the connector apparatus in accordance with the preferred embodiment of the present invention.

FIG. 1 shows the connector apparatus 10 in accordance with the preferred embodiment of the present invention. The connector apparatus 10 includes a first electroluminescent cable 12, a second electroluminescent cable 14, a body 16, a first conductive surface 18 and a second conductive surface 20. The first electroluminescent cable 12 has a first wire 22 and a second wire 24 extending therefrom. The second electroluminescent cable 14 has a first wire 26 and a second wire 28 extending therefrom. The body 16 has an interior 30 formed therein. The first electroluminescent cable 12 extends through one end of the body 16 into the interior 30. The second electroluminescent cable 14 extends through an opposite end of the body 16 into the interior 30. The first conductive surface 18 is positioned in the interior 30 of the body 16. The first wire 22 of the first electroluminescent cable 12 and the first wire 26 of the second electroluminescent cable 14 are electrically connected to the first conductive surface 18. The second conductive surface 20 is also positioned in the interior 30 of the body 16. The second wire 24 of the first electroluminescent cable 12 and the second wire 28 of the second electroluminescent cable 14 are electrically connected to the second conductive surface 20.

The body 16 is formed of a first shell 32 and a second shell 34. A hinge 36 connects the first shell 32 to the second shell 34. Hinge 36 allows the second shell 34 to be movable between an open position (as shown in FIG. 1) and a second position closed over the interior 30 of the first shell 32. A suitable clasp 38 is illustrated as provided on the second shell 34 so as to allow the second shell 34 to be locked over the first shell 32 when in the closed position. The first shell 32 and the second shell 34 are formed of a nonconductive polymeric material.

A separating surface 40 is positioned within the interior of the body 16. In particular, the separating surface 40 will be positioned within the interior of the first shell 32 so as to extend vertically upwardly generally at a center of the first shell 32. The separating surface 40 is also formed of a nonconductive polymeric material. The separating surface 40 serves to separate the wires of the electroluminescent cables 12 and 14. In particular, as can be seen in FIG. 1, the first wire 22 and the second wire 24 of the first electroluminescent cable 12 are positioned on opposite sides of the separating surface 40. Similarly, the first wire 26 and the second wire 28 of the second electroluminescent cable 14 are also positioned on opposite sides of the separating surface 40. As such, the separating surface 40 serves to electrically isolate the wires 22 and 24 from each other and also to separate the wires 26 and 28 from each other. The separating surface 40 is also used so as to electrically isolate the first conductive surface 18 from the second conductive surface 20.

As will be described hereinafter in association with FIG. 4, the first conductive surface 18 includes a first clip 42 and a second clip 44 with a conductor 46 extending therebetween. Each of the first clip 42 and the second clip 44 have a sharp edge therealong. This sharp edge can be suitable so as to penetrate the coating over the first wire 22 of the first electroluminescent cable 12. As such, by applying the wire 22 within the first clip 42 and the wire 26 within the second clip 44, an electrical connection is established between the respective clips and the respective wires. The conductor 46 is in the nature of a flat surface extending between the clips 42 and 44 adjacent the bottom of the first shell 32.

The second conductive surface 20 includes a clip 50 and a plate 52 along with a conductor 54. The clip 50 is similar in structure to the clips 42 and 44. As such, it will have a sharp edge that can penetrate through the coating of the second wire 24 of the first electroluminescent cable 12. The plate 52 extends in a generally horizontal orientation transverse to the clip 50. As such, the plate 52 provides a surface so as to electrically connect with the second wire 28 of the second electroluminescent cable 14. It can be seen in FIG. 1 that there are a pair of filaments associated with the second wire 28. These filaments will be juxtaposed against the plate 52 so as to electrically connect with the plate. The conductor 54 will extend between the clip 50 and the plate 52 so as to establish an electrical connection therebetween. As such, through this structure, the pair of filaments associated with the second wire 28 of the second electroluminescent cable 14 can be electrically connected to the second wire 24 of the first electroluminescent cable 12.

The second shell 34 has several structures formed on the interior thereof which cooperate with the structures associated with the first shell 32 so as to facilitate the electrical connections between the wires of the first and second electroluminescent cables. In particular, there is an abutment surface 60 which extends from the interior of the second shell 34. Abutment surface 60 will bear against the pair of filaments associated with the second wire 28 of the second electroluminescent cable 14 so as to urge such filaments into electrical connection with the plate 52. Additionally, the second shell 34 includes a first pair of panels 62 and a second pair of panels 64. Each of the panels of the first and second pairs will be arranged in spaced relationship. As such, when the second shell 34 is closed over the first shell 32, the first pair of panels 62 will reside on opposite sides of the first clip 42 so as to urge the first wire 22 downwardly into the clip 42. This will automatically cause the sharp edges to the clip 42 to penetrate the coating of the first wire 22 so as to facilitate the electrical connection. A similar action occurs with respect to the second pair of panels 64 in association with the clip 50 and the second wire 24. A third pair of panels 66 are positioned on the interior of the second shell 34. Once again, when the second shell 34 is closed upon the first shell 32, the pair of panels 66 will be positioned on opposite sides of the clip 44 so as to urge the first wire 26 into the sharp edges of the clip 44.

Figure 2:
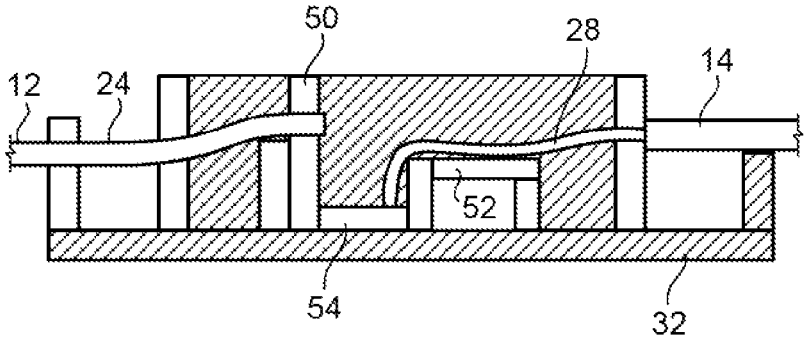
FIG. 2 is an isolated view showing the positioning of the wires of the electroluminescent cable within the first shell of the connector apparatus of the present invention.
Figure 5:
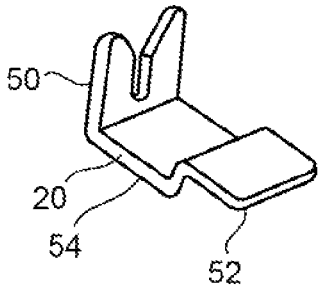
FIG. 5 is a perspective of the second conductor surface as used in the connector apparatus of the present invention.

FIG. 2 is an illustration of the arrangement of the second wire 24 within the interior 30 of the first shell 32. It can be seen that the wire 24 will extend so as to have an end affixed within the clip 50. Clip 50 is electrically connected by conductor 54 to the panel 52. As can be seen in FIG. 5, the clip 50, the conductor 54 and the plate 52 are integrally formed together of the conductive material. The second wire 28 will extend so as to have a surface juxtaposed against the plate 52. The operation of the clip 50, along with the conductor 54 and the plate 52, will establish the electrical connection between the wire 24 and the wire 28.

Figure 3:
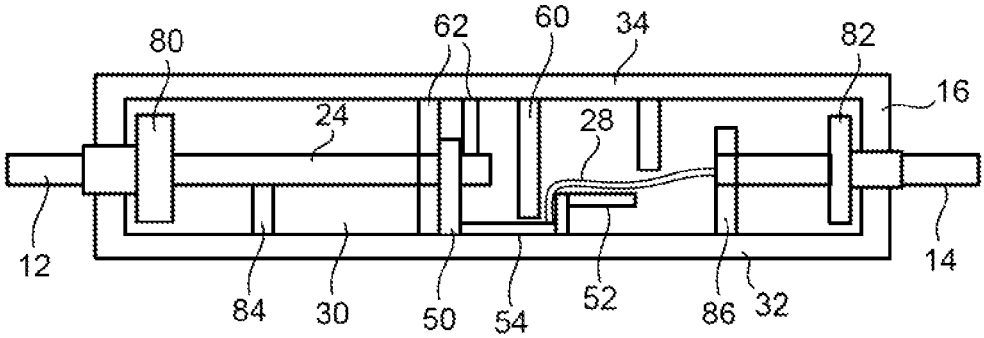
FIG. 3 is a cross-sectional view showing the connection of the electroluminescent cables within the interior of the body of the connector apparatus of the present invention, the body being shown in a closed position.

FIG. 3 illustrates the body 16 with the second shell 34 in a closed position over the first shell 32. In FIG. 3, it can be seen that there is a first elastomeric receptacle 80 positioned at one end of the first shell 32. The first elastomeric receptacle 80 has an opening therethrough. As such, the first electroluminescent cable 12 can extend through the opening of the elastomeric receptacle 80 and into the interior 30 of the body 16. The second wire 24 of the first electroluminescent cable 12 is illustrated as received within the clip 50. The pair of plates 62 are arranged on opposite sides of the clip 50. As such, the pair of plates 62 urge the wire 24 downwardly into the clip 50 so as to establish the electrical connection with the clip 50. The conductor 54 extends from the clip 50 to the plate 52. The abutment surface 60 extends downwardly from the second shell 34 so as to bear upon the pair of the filaments associated with the second wire 24 of the second electroluminescent cable 14. As such, a proper electrical connection is established between the second wire 28 and the plate 52. The abutment surface 60 also serves to electrically isolate the filaments associated with the second wire 28 from the second wire 24 of the first electroluminescent cable 12. A second elastomeric receptacle 82 is positioned at the opposite end of the body 16. The second elastomeric receptacle 82 has an opening therethrough. The second electroluminescent cable 14 will extend through the opening of the second elastomeric receptacle 82. The first shell 32 also includes certain support structures 84 and 86 therein. The structural support 84 serves to maintain the second wire 24 in a generally linear orientation toward the clip 50. Similarly, the support structure 86 will maintain the second wire 28 in an orientation extending toward the plate 52.

The first elastomeric receptacle 80 and the second elastomeric receptacle 82 can be formed of a rubber material. These elastomeric receptacles 80 and 82 provide additional strength in maintaining the electroluminescent cables 12 and 14 within the connector apparatus 10. These elastomeric receptacles 80 and 82 also present a cleaner appearance at the respective ends of the body 16. The elastomeric receptacles 80 and 82 also provide an amount of liquid resistance. The elastomeric receptacles 80 and 82 can also be provided so as to adapt to the various sizes of electroluminescent cables. It should be noted that the smallest electroluminescent cable is approximately 0.9 millimeters in diameter while the largest electroluminescent cable is 5 millimeters in diameter. The openings at the ends of the body 16 will be of a size that can accommodate up to 5 millimeter diameter electroluminescent cables without the need for the elastomeric receptacles 80 and 82. The elastomeric receptacles 80 and 82 facilitate the ability to adapt smaller electroluminescent cables within the a large openings at the ends of the body 16.

Various types of clip and plate configurations can be made within the scope of the present invention. The various types of configurations of clips and plates can be adapted to the particular size of the core of the wires of the electroluminescent cables. Additionally, it should be noted that it is possible to introduce glue or epoxy within the body 16 so as to further seal the wires of the electroluminescent cables therein.

Figure 4:
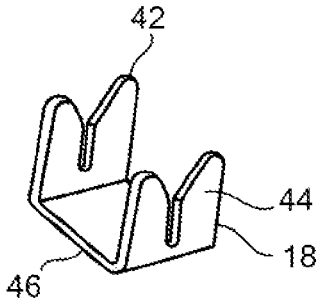
FIG. 4 is an perspective view showing the first conductive surface as used within the connector apparatus of the present invention.

FIG. 4 is an isolated view of the first conductive surface 18. It can be seen that the first conductive surface 18 includes the first clip 42 and the second clip 44 with the conductor 46 extending therebetween. The clips 42 and 44 extend in transverse relationship to the conductor 46. The conductor 46 is in the nature of a flat plate that can reside against the bottom of the first shell 32. Each of the clips 42 and 44 has a generally V-shaped upper opening which tapers inwardly to a center slot. As such, when the second shell 34 is closed, the pair of plates can push the wire into the slot at the bottom of the V-shaped opening.

FIG. 5 is an isolated view showing the second conductive surface 20. The second conductive surface 20 includes a clip 50 and a plate 52. The plate 52 will extend in transverse relationship to the plane of the clip 50. A conductive surface 54 will extend between the clip 50 and the plate 52. The conductive surface 54 will extend in generally parallel planar relationship to the conductive surface 54. The conductive surface 54 is suitably flat so as to reside at the bottom of the interior 30 of the first shell 32. The clip 52 has a similar configuration to the clips 42 and 44 associated with the first conductive surface 18.

Through the use of the present invention, an easy and quick connection between the wires of the electroluminescent cables can be achieved. It is only necessary to split the first electroluminescent cable into the separate wires 22 and 24. The separate wires 22 and 24 will extend on opposite sides of the separating surface 40. Each of the separate wires 22 and 24 can be placed into the V-shaped openings of the conductive surfaces. The second electroluminescent cable 14 can be introduced into the opposite end of the body 16. The pair of filaments associated with the second wire 28 are separated from the wire 26. The wire 26 can be placed into the clip 44 of the first conductive surface 18 and the pair of the filaments can be placed upon the plate 52 of the second conductive surface 20. The second shell 34 can then be closed upon the first shell 32 so that the surfaces within the second shell 34 will urge the respective wires downwardly into the clips of the first and second conductive surfaces and also cause the pair of filaments to reside in electrical connection with the plate 52. As such, a proper, easy and effective electrical connection is established between the wires of the first and second electroluminescent cables.

The foregoing disclosure and description of the invention is illustrative and explanatory thereof. Various changes in the details of the illustrated construction can be made within the scope of the appended claims without departing from the true spirit of the invention. The present invention should only be limited by the following claims and their equivalents.

I claim:

1. A connector for electroluminescent cables comprising:
- a first shell having an interior;
- a separating surface positioned in said interior;
- a first conductive surface positioned in said interior of said first shell on one side of said separating surface;
- a second conductive surface positioned in said interior of said first shell on an opposite side of said separating surface, said second conductive surface comprising:
  - a clip positioned in said interior of said first shell;
  - a plate positioned in said interior of said first shell; and
  - a conductor extending in electrical connection between said clip and said plate, a second shell being movable between an open position and a closed position with respect to said interior of said first shell, said second shell having a planar abutment surface extending so as to be positioned adjacent said plate when said first and second shells are in the closed position so as to urge said filament of the electroluminescent cable against said plate; and a second shell cooperative with said first shell so as to extend over said interior of said first shell.

2. The connector of claim 1, said first shell being hingedly connected to said second shell.

3. The connector of claim 1, said second shell being movable between an open position and a closed position with respect to said interior of said first shell.

4. The connector of claim 1, said first conductive surface comprising:

a first clip positioned in said interior of said first shell;

a second clip positioned in said interior of said first shell in spaced relation to said first clip; and a conductor extending between said first clip and said second clip so as to electrically connect said first and second clips.

5. The connector of claim 4, each of said first and second clips having a sharp edge suitable for penetrating a coating of a wire of the electroluminescent cable.

6. The connector of claim 1, said plate extending in transverse relationship to said clip, said conductor being a surface extending adjacent a bottom of said interior of said first shell.

7. The connector of claim 4, said second shell having a pair of panels arranged in spaced parallel relationship, said first clip residing between said plurality of panels when said second shell is in the closed position.

8. The connector of claim 1, further comprising:

a first elastomeric receptacle positioned at one end of said first shell, said first elastomeric receptacle having an opening therein suitable for allowing one of the electroluminescent cables to pass therethrough; and a second elastomeric receptacle positioned at an opposite end of said first shell, said second elastomeric receptacle having an opening therein suitable for allowing the other of the electroluminescent cables to pass therethrough.

9. The connector of claim 1, said separating surface extending vertically within said first shell, said separating surface having one end positioned beyond an end of said first and second conductive surfaces and an opposite end positioned beyond an end of said first and second conductive surfaces.

10. The connector of claim 1, each of said first and second shells and said separating surface being of a non-conductive material.

11. A connector apparatus comprising:

a first electroluminescent cable having a first wire and a second wire therein;

a second electroluminescent cable having a first wire and a second wire therein;

a body having an interior, said first electroluminescent cable extending through one end of said into said body into said interior, said second electroluminescent cable extending through an opposite end of said body into said interior;

a first conductive surface positioned in said interior of said body, said first wire of said first electroluminescent cable and said first wire of said second electroluminescent cable being electrically connected to said first conductive surface; and a second conductive surface positioned in said interior of said body, said second wire of said first electroluminescent cable and said second wire of said second electroluminescent cable being electrically connected to said second conductive surface, said second conductive surface comprising:

a clip positioned in said interior of said body;

a plate positioned in said interior of said body in spaced relation to said clip; and a conductor electrically connecting said clip to said plate, said second wire of said first electroluminescent cable electrically connected to said clip, said second wire of said second electroluminescent cable comprising a pair of filaments each having a surface juxtaposed against said plate, said body having a planar abutment surface extending toward said plate so as to urge said pair of filaments against said plate.

12. The connector apparatus of claim 11, said body comprising:

a first shell; and a second shell hingedly connected to said first shell.

13. The connector apparatus of claim 11, said first conductive surface comprising:

a first clip positioned in said interior of said body;

a second clip positioned in said interior of said body in spaced relation to said first clip; and a conductor electrically connected said first slip and to said second clip, said first wire of said first electroluminescent cable being electrically connected to said first clip, said second wire of said second electroluminescent cable being electrically connected to said second clip.

14. The connector apparatus of claim 13, each of said first and second clips having a sharp edge penetrating a coating of the wire so as to electrically connect the wire to the clip.

15. The connector apparatus of claim 11, further comprising:

a separating surface positioned in said body, said first wire of said first electroluminescent cable and said first wire of said second electroluminescent cable extending along one side of said separating surface, said second wire of said first electroluminescent cable and said second wire of said second electroluminescent cable extending along an opposite side of said separating surface.

16. The connector apparatus of claim 11, further comprising:

a first elastomeric receptacle positioned at said one end of said body, said first elastomeric receptacle having an opening therein, said first electroluminescent cable extending through said opening of said first elastomeric receptacle; and a second elastomeric receptacle positioned at said opposite end of said body, said second elastomeric receptacle having an opening therein, said second electroluminescent cable extending through said opening of said second elastomeric receptacle.

* * * * *